United States Patent [19]

Kohzuki et al.

[11] 4,386,331

[45] May 31, 1983

[54] DEFLECTION YOKE

[75] Inventors: Keiji Kohzuki, Yokohama; Tsuneo Yoshida, Tokyo, both of Japan

[73] Assignee: Denki Onkyo Co., Ltd., Tokyo, Japan

[21] Appl. No.: 270,544

[22] Filed: Jun. 4, 1981

[30] Foreign Application Priority Data

Jun. 6, 1980 [JP] Japan ..... 55-76400

[51] Int. Cl.[3] ..... H01F 3/12

[52] U.S. Cl. ..... 335/211; 335/213

[58] Field of Search ..... 335/211, 210, 212, 213

[56] References Cited

U.S. PATENT DOCUMENTS 3,899,761 8/1975 Yamauchi ..... 335/211

4,246,560 1/1981 Shimizu et al. ..... 335/212

FOREIGN PATENT DOCUMENTS 2010005 6/1979 United Kingdom .

2013972 8/1979 United Kingdom .

*Primary Examiner*—Harold Broome

*Attorney, Agent, or Firm*—Armstrong, Nikaido, Marmelstein & Kubovcik

[57] ABSTRACT

The deflection yoke for use in the in-line type color cathode-ray tube comprises a horizontal deflection yoke, vertical deflection yoke and core, and the vertical deflection coil is an or/and auxiliary magnetic field correcting means which generates the vertical deflection magnetic field of the screen side in the form of a pincushion. A set of correction members made of mild magnetic material consisting of circular lugs which extend in the circumferential direction of the neck of the cathode-ray tube and center lugs which extend in the direction of the tube axis are provided at the north and south positions between the horizontal deflection coil at the electron gun side of the deflection yoke and the vertical deflection coil to simultaneously correct misconvergence in the horizontal and vertical directions at the corners of the fluorescent screen.

8 Claims, 9 Drawing Figures

DEFLECTION YOKE

BACKGROUND OF THE INVENTION

The present invention relates to the deflection yoke for use in the color cathode-ray tube which provides three electron beams in an in-line arrangement.

As known, the color cathode-ray tube provided with the electron guns which emit three electron beams in the in-line arrangement employs the deflection yoke which ensures normal convergence of three electron beams only by the deflection magnetic field of the deflection yoke. Such deflection yoke makes the magnetic field produced by the horizontal deflection coil a pincushion-distributed magnetic field and the magnetic field produced by the vertical deflection coil a barrel-distributed magnetic field to carry out convergence correction and this deflection yoke is therefore referred to as the self-convergence type deflection yoke.

A pincushion distortion resulting from the barrel-distributed magnetic field at the screen side of the vertical deflection magnetic field produced from the vertical deflection coil takes place at the right and left ends of the picture on the fluorescent screen of the color cathode-ray tube in addition to the pincushion distortion resulting from the curvature of the fluorescent screen of the cathode-ray tube.

Conventionally, the pincushion distortion, so-called "side pincushion distortion" which takes place at the right and left ends of the picture as described above is corrected by means of a special pincushion distortion correction circuit or by forming the vertical deflection magnetic field of the deflection yoke in the shape of pincushion at the screen side, that is, the front side of the deflection yoke and in the shape of barrel at the electron gun side, that is, the rear side of the deflection yoke, without using the pincushion distortion correction circuit.

Such deflection yoke which is referred to as the side pincushionless type deflection yoke includes (1) the deflection yoke comprising the vertical deflection coil which is wound to generate a pincushion-distributed magnetic field at the screen side and a barrel-distributed vertical deflection magnetic field of the vertical deflection coil at the electron gun side, (2) the deflection yoke provided with a set of magnetic plates as described in the U.K. patent publication No. GB 2010005A and (3) the deflection yoke for wide angle deflection which is made up by combining the deflection yokes described in (1) and (2).

In case of the deflection yoke as described above, however, the misconvergence of the vertical deflection magnetic field produced by the vertical deflection coil cannot be corrected only by virtue of the increased intensity of the barrel-distributed magnetic field at the electron gun side. For example, a horizontal misconvergence that the raster B formed by the blue beam 22 at the corners of the picture is not converged to the raster R formed by the red beam 24 takes place as shown in FIG. 1 and, for example, a vertical misconvergence takes place as shown in FIG. 2 when the deflection sensitivity for the green beam 23 which forms the raster G at the corners of the picture is insufficient and it is consequently difficult to obtain high quality pictures on the screen.

SUMMARY OF THE INVENTION

An object of the present invention is to provide the deflection yoke which is capable of preventing misconvergence at the corners of the picture and provides high quality picture characteristics.

In other words, the deflection yoke in accordance with the present invention is made up by inserting a correction member, which is made of a mild magnetic material with high magnetic permeability and has circular lugs which extend in the circumferential direction of the neck of the cathode-ray tube and center lugs which continue these circular lugs and extend in the direction of the tube axis to correct horizontal and vertical misconvergences at the corners of the picture, between the horizontal deflection coil and the vertical deflection coil.

DETAILED DESCRIPTION OF THE PREFERRED EMBODIMENTS

Figure 1:
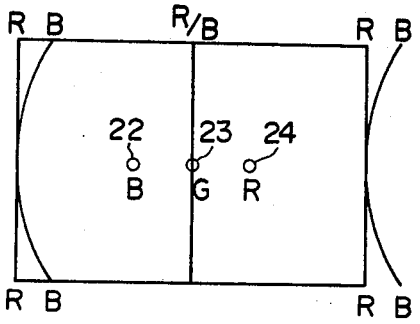
FIG. 1 PRIOR ART
FIG. 1 shows a horizontal misconvergence which takes place at the corners of the fluorescent screen when the conventional side pincushionless type deflection yoke is employed.

The following describes in detail an embodiment of the present invention with the side pincushionless type deflection yoke as an example while referring to the drawings.

Figure 3:
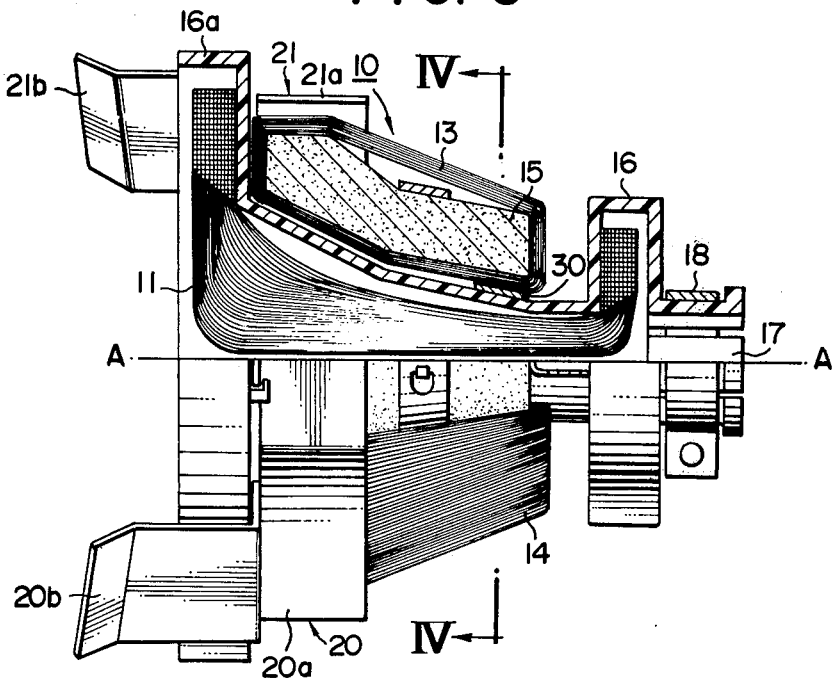
FIG. 3 is a side view of the deflection yoke which is an embodiment of the present invention with the section of the upper half above the single-dot broken line A—A.
Figure 4:
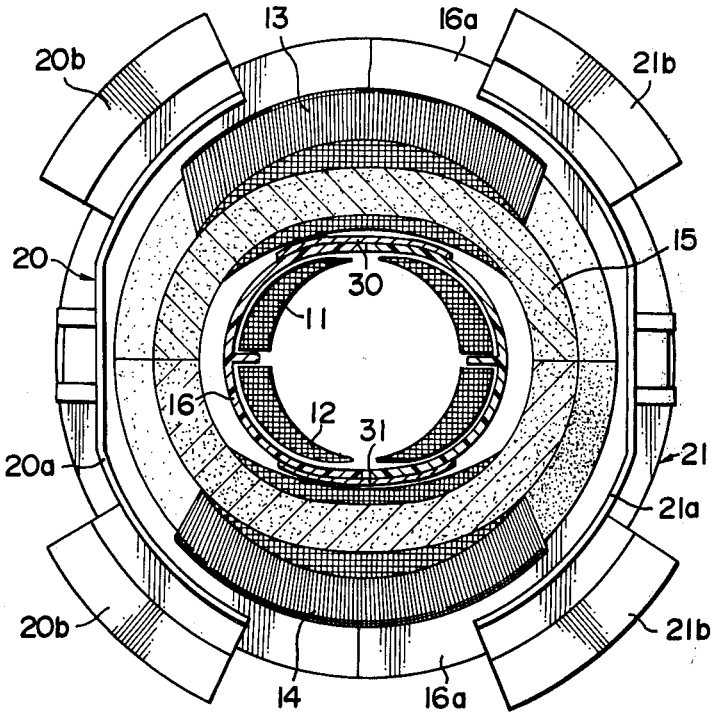
FIG. 4 is a sectional view of the deflection yoke shown in FIG. 3 as cut along the broken line IV—IV and viewed in the arrowhead direction.

In FIGS. 3 and 4, the deflection yoke 10 comprises the horizontal deflection coils 11 and 12 which are wound in the form of saddle, coil separator 16 inside which said horizontal deflection coils 11 and 12 are arranged, annular core 15 which is mounted on the external surface of the coil separator 16, and vertical deflection coils 13 and 14 which are toroidally wound around the annular core 15. This deflection yoke is mounted and fixed by tightening the clamp tag 17 provided at the rear end of the coil separator 16 with the clamp band 18 to a smaller diameter on the neck of the color cathode-ray tube in which the field control elements are provided respectively for three electron beams so that three electron beams of red, blue and green are in-line arranged in the horizontal direction as described in, for example, the U.S. Pat. No. 3,860,850.

On the front part of the deflection yoke 10 (the screen side of the cathode-ray tube), the arm-shaped magnetic field correction means 20 and 21 which are made of mild magnetic material with excellent magnetic permeability are fixed on the front expanded part 16*a* of the coil separator 16 to generate a pincushion-distributed magnetic field of the vertical deflection coil at the front part of the deflection yoke 10 and correct the side pincushion distortion which results from the vertical deflection magnetic field. The magnetic field correction means 20 and 21 comprise semi-circular magnetic field receiving parts 20*a* and 21*a* which pick up the vertical deflection magnetic field leaking from the vertical deflection coils 13 and 14 and the arm-shaped magnetic field forming parts 20*b* and 21*b* which are located at both ends of said magnetic field receiving parts and extended to the screen side of the cathode-ray tube to form a pincushion-distributed auxiliary vertical deflection field. The magnetic field correction means 20 and 21 are arranged at symmetrically opposing positions in the east-west direction in reference to the tube axis on the front expanded part 16*a* of the coil separator along the peripheries of the vertical deflection coils 13 and 14.

On the other hand, a set of correction members 30 and 31 which are made of mild magnetic material such as permalloy with high magnetic permeability are fixed at symmetrical north-south positions on the external surface of the coil separator 16 between the horizontal deflection coils 11 and 12 the vertical deflection coils 13 and 14 of the rear part of the deflection yoke 10 (the electron gun side of the cathode-ray tube).

Figure 5:
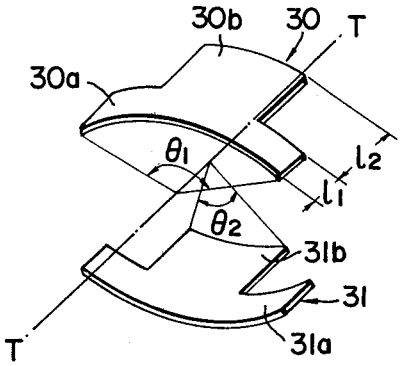
FIG. 5 is a perspective view of the correction member for use in the deflection yoke in accordance with the present invention.

FIG. 5 shows the examples of the correction members 30 and 31. The correction members 30 and 31 are formed in a T-shape comprising circular lugs 30*a* and 31*a* which extend in the circumferential direction of the neck of the cathode-ray tube and the center lugs 30*b* and 31*b* which continue the circular lugs and extend in the direction T of the tube axis and have a smaller width than the circular lugs in the circumferential direction. The practical circumferential length of the circular lugs 30*a* and 31*a*, that is, the angle $\Theta_1$ from the tube axis T is determined to be $130° > \Theta_1 \geqq 100°$ and the practical circumferential length of center lugs 30*b* and 31*b*, that is, the angle $\Theta_2$ from the tube axis is determined to be $100° > \Theta 2 > 20°$. The ratio $l_1/l_2$ of length $l_1$ of circular lugs 30*a* and 31*a* in the direction of the tube axis to length l2 of center lugs 30*b* and 31*b* is determined to be 1 to $\frac{1}{3}$. If the center lugs 30*b* and 31*b* are given the above dimensions, the vertical center raster, so called "coma green height" on the screen tends to produce a "narrow" misconvergence and the horizontal misconvergence at the corners of the picture tends to result in a raster deviation reverse to the beam arrangement, so-called "under" misconvergence. In case of the circular lugs given the above dimensions, the vertical center raster tends to produce a "wide" misconvergence and the so-called "over" misconvergence which tends to take place as the horizontal misconvergence at the corners of the picture causes raster deviation in the same direction as the beam arrangement.

Consequently, the general function of the correction members 30 and 31 consisting of the functions of circular lugs 30*a* and 31*a* and center lugs 30*b* and 31*b* causes a strong "over" misconvergence due to the effect of circular lugs 30*a* and 31*a* to tend to take place and a "narrow" misconvergence due to the effect of center lugs 30*b* and 31*b*.

As the preferable embodiment, the circular lugs 30*a* and 31*a* and center lugs 30*b* and 31*b* of the correction members 30 and 31 are provided with angle $\Theta_1$ determined to be approximately 115° and angle $\Theta_2$ determined to be approximately 55° so that the vertical deflection magnetic field is effectively affected in response to the width of windings of the vertical deflection coils 13 and 14 which are toroidally wound on the core 15 and the length $l_1$ and $l_2$ in the direction of the tube axis of circular lugs 30*a* and 31*a* and center lugs 30*b* and 31*b* is set to approximately $l_1 = 7$ mm and $l_2 =$ mm so that the vertical deflection magnetic field is effectively affected.

Figure 6:
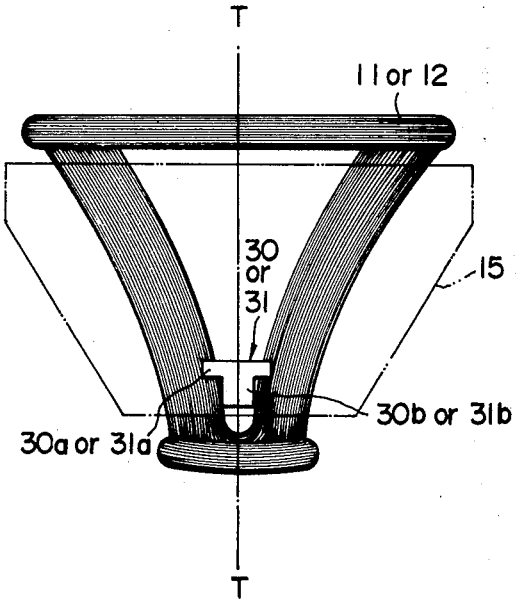
FIG. 6 shows the relative position of the correction member of the present invention to the horizontal deflection coil.

FIG. 6 shows the relative positions of the horizontal deflection coil 11 or 12 which is one of the set of coils and the correction member 11 or 12. The horizontal deflection coil 11 or 12 is arranged in position in a vertical plane passing through the tube axis T—T of the cathode-ray tube. The correction member 30 or 31 is arranged at a position of the electron gun side above the horizontal deflection coil and the circular lug 30*a* or 31*a* and the center lug 30*b* or 31*b* of the correction member are symmetrically positioned in reference to the vertical plane which passes through the tube axis. The core 15 shown with a single-dot broken line is arranged above the correction member 30 or 31.

By the relative positions as described above, the vertical deflection magnetic field which is produced from the vertical deflection coils 13 and 14 on the rear part of the deflection yoke 10 is made to a special barrel-distributed magnetic field.

Since the correction members 30 and 31 are positioned outside the horizontal deflection coils 11 and 12, the horizontal deflection magnetic field generated from the horizontal deflection coil is affected as the core 15 approaches it and the barrel-distributed magnetic field at the rear part is slightly intensified but the effect is not so large.

In case of the deflection yoke with the above-mentioned construction, the vertical deflection magnetic field at the front part of the deflection yoke 10 is made to the pincushion-distributed magnetic field by the action of the arm-shaped magnetic field correction means 20 and 21 which are fixed on the front part of the deflection yoke 10 and the side pincushion distortion of the picture is corrected.

Figure 2:
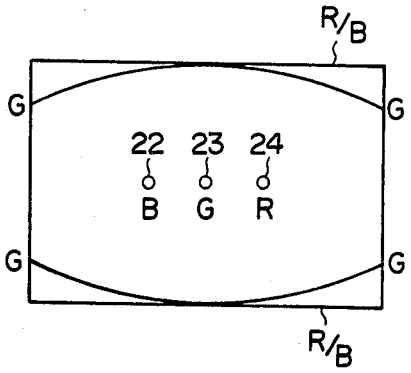
FIG. 2 PRIOR ART
FIG. 2 shows a vertical misconvergence which similarly takes place at the corners of the picture.
Figure 7:
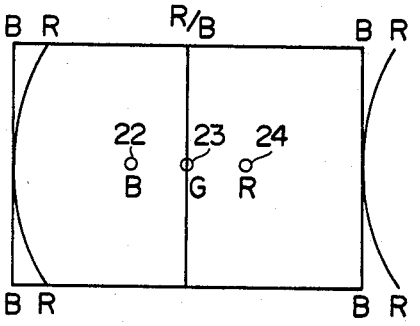
FIG. 7 shows an imaginative distortion of rasters which are formed by the red beam and the blue beam generated by the deflection yoke of the present invention.
Figure 8:
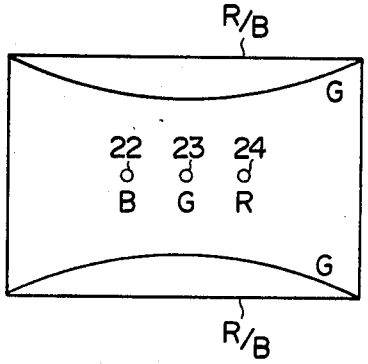
FIG. 8 shows an imaginative distortion of the raster similarly formed by the green beam.

On the other hand, the vertical deflection magnetic field at the rear part of the deflection yoke 10 is made to the barrel-distributed magnetic field by the action of a set of correction members 30 and 31 which are mounted in vertical symmetry between the horizontal deflection coils 11 and 12 and the vertical deflection coils 13 and 14. The raster distortion reverse to the raster distortion shown in FIG. 1 that the raster R formed by red beam 24 is not converged to the raster B formed by blue beam 22 is caused, as shown in FIG. 7, by the action of the circular lugs 30*a* and 31*a* which form the correction members 30 and 31. Thus the horizontal misconvergence of the raster R by red beam 24 and the raster B by blue beam 22 is offset and corrected. The vertical deflection magnetic field is modified to cause the raster G formed by green beam 23 from the center electron gun to be distorted from the top and bottom of the screen toward the inside by the action of the center lugs 30*a* and 31*b* which form the correction members 30 and 31. As a result of such modification, the raster distortion which takes place, as shown in FIG. 8, when the deflection sensitivity of the raster G formed by green beam 23 is insufficient is caused and the vertical misconvergence at the corners of the picture shown in FIG. 2 is offset and corrected. Consequently high quality picture characteristics of the whole picture free from side pincushion distortion and misconvergence can be obtained.

The types of the deflection yoke which can employ the correction members 30 and 31 shown in FIG. 5 include (A) the deflection yoke provided with the arm-shaped magnetic field correction means 20 and 21 at the front part of the deflection yoke as described above, (B) the deflection yoke in which the conductor distribution of the vertical deflection coil toroidally wound around the core 15 provides a pincushion vertical deflection magnetic field at the screen side (this vertical deflection coil can be made up by winding the conductor concentratedly from two points of the electron gun side to one point of the screen side around the core 15 in the V shape), and (C) the deflection yoke made up by combining the deflection yokes described in (A) and (B).

The above embodiment shows an example of the deflection coil in which a set of correction members 30 and 31 are inserted between the horizontal deflection coils 11 and 12 provided at the rear part of the deflection yoke and the vertical deflection coils 13 and 14. In this case, the correction members 30 and 31, as shown in FIG. 6, can be slightly shifted to the screen side or to the electron gun side along the tube axis T—T. When the correction members 30 and 31 come out of the core 15, an effect appears as if the core is extended to the horizontal deflection coils 11 and 12.

The dimensions of the circular lugs 30*a* and 31*a* and the center lugs 30*b* and 31*b* of the correction member 30 and 31 are experimentally in compliance with the type of the deflection yoke and the type of the cathode-ray tube.

Figure 9:
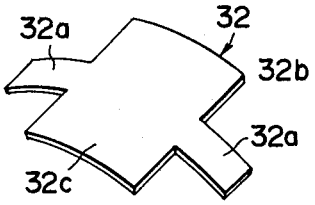
FIG. 9 is a perspective view showing another embodiment of the correction member for use in the deflection yoke according to the present invention.

FIG. 9 shows another embodiment of the correction members. The correction member 32 has the center lug 32*b* which is extended toward the screen beyond the position of the circular lug 32*a* to form the center lug 32*c* and is thus made in the form of cross. If a set of the correction members 32 is employed, the vertical misconvergence at the corners of the picture can be more effectively corrected.

As described above, the deflection yoke according to the present invention comprises the saddle type horizontal deflection coil, coil separator inside which the horizontal deflection coil is arranged, core which is provided on the external surface of the coil separator and vertical deflection coil which is wound around the core, wherein a set of correction member made of mild magnetic material consisting of the circular lugs which extend in the circumferential direction of the neck of the cathode-ray tube to correct horizontal misconvergence and the center lugs which extend in the direction of the tube axis to correct vertical misconvergence at the corners of the picture are provided between the horizontal deflection coil and the vertical deflection coil.

Accordingly, if this deflection yoke is employed in the in-line type color cathode-ray tube, the vertical deflection magnetic field generated from the vertical deflection coil is formed as a special barrel-distributed magnetic field by the action of a set of correction members at the rear part of the deflection yoke, and as a result of such correction horizontal misconvergence at the corners of the picture is corrected by the circular lugs and vertical misconvergence at the corners of the picture is corrected by the center lugs of the correction members.

Consequently, the deflection yoke with high quality picture characteristics and free from the misconvergence of the whole picture can be finally obtained by employing the correction members of extremely simple construction. The correction members for misconvergence as described above are particularly effective for the side pincushion less deflection yoke as descibed above if employed and the magnetic field control elements provided in response to the electron beams in the cathode-ray tube intensify the effect of the convergence of three electron beams if these elements are employed.

What is claimed is:

1. A deflection yoke for use in a color cathode-ray tube provided on its neck with a plurality of electron guns for emitting three electron beams in an in-line arrangement onto a screen, which comprises (a) an annular core, (b) a set of horizontal deflection coils, wound in the form of a saddle, for generating a pincushion horizontal deflection magnetic field at the screen side of the tube, (c) a set of vertical deflection coils located outside said horizontal deflection coils and toroidally wound around said core for generating a barrel distributed magnetic field at the gun side of the tube, (d) a coil separator positioned between said horizontal deflection coils and said vertical deflection coils to electrically separate said deflection coils, (e) pincushion deflection means for generating a pincushion type vertical deflection magnetic field at the screen side of said deflection yoke, and (f) a set of correction means, of a mild magnetic material, located between said horizontal deflection coils and said vertical deflection coils at north-south (vertical) positions of an electron gun side of said deflection yoke, each correction means including circular lugs which extend in a circumferential direction of said neck of the cathode-ray tube to correct horizontal misconvergence at corners of the tube screen and a center lug integral with said circular lugs, which extends in the direction of the tube axis of said cathode-ray tube and has a smaller length in the circumferential direction of said neck than said circular lugs to correct vertical misconvergence at the corners of the tube screen.

2. A deflection yoke in accordance with claim 1, wherein said pincushion deflection means comprises a set of U-shaped magnetic field correcting means which are made of a mild magnetic material positioned at the screen side of said coil separator.

3. A deflection yoke in accordance with claim 1, wherein said pincushion deflection means comprises the conductors of said vertical deflection coils wound concentratedly around the screen side of said core.

4. A deflection yoke in accordance with any one of claims 1 to 3, wherein said correction means is provided with a second center lug integral with said circular lugs and extends in the direction of the tube axis.

5. A deflection yoke in accordance with any one of claims 1 to 3, wherein said correction means are provided with circular lugs and a center lug which are symmetrically arranged at the right and left sides in reference to a verrical plane passing through the tube axis.

6. A deflection yoke for use in a color cathode-ray tube provided on its neck with a plurality of electron guns for emitting three electron beams in an in-line arrangement onto a screen, which comprises (a) an annular core, (b) a set of horizontal deflection coils which are wound in a form of saddle and constructed to generate a pincushion horizontal magnetic field, (c) a set of vertical deflection coils which are located outside said horizontal deflection coils and have a conductor which extends inside said core, each coil being wound to provide pincushion-distributed vertical deflection magnetic field at the screen side and barrel-distributed vertical deflection magnetic field at the electron gun side, (d) a coil separator which is provided between said horizontal deflection coils and said vertical deflection coils to electrically separate both types of said deflection coils, (e) a set of correction means, made of a mild magnetic material, located between said horizontal deflection coils and said vertical deflection coils at the vertical positions of the electron gun side of said deflection yoke, each correction means including circular lugs which extend in the circumferential direction of said neck of the cathode-ray tube to correct horizontal misconvergence at corners of a screen and a cetner lug integral with said circular lugs, extending in the direction of the tube axis of said cathode-ray tube and has a smaller length in the circumferential direction of said neck than said circular lugs, to correct vertical misconvergence at the corners of said screen.

7. A deflection yoke in accordance with claim 6, wherein an angle from the tube axis of said correction means is $130° > \Theta_2 \geqq 100°$ for said circular lugs and $100° > \Theta > 20°$ for said center lug.

8. A deflection yoke in accordance with claim 6, wherein a ratio of length $l_1$ of the circular lug in the direction of the tube axis to length $l_2$ of the center lug of said correction means is $l_1/l_2 = 1 \sim \frac{1}{3}$.

* * * * *